US008113249B2

(12) United States Patent
Yang

(10) Patent No.: US 8,113,249 B2
(45) Date of Patent: Feb. 14, 2012

(54) MULTI-FUNCTION MORTISE/TENON APPARATUS

(76) Inventor: Jack Yang, Fongyuan (TW)

( * ) Notice: Subject to any disclaimer, the term of this patent is extended or adjusted under 35 U.S.C. 154(b) by 256 days.

(21) Appl. No.: 12/562,191

(22) Filed: Sep. 18, 2009

(65) Prior Publication Data

US 2010/0006180 A1 Jan. 14, 2010

Related U.S. Application Data

(63) Continuation-in-part of application No. 11/785,518, filed on Apr. 18, 2007, now abandoned.

(51) Int. Cl.
*B27F 5/02* (2006.01)

(52) U.S. Cl. ..... 144/82

(58) Field of Classification Search ..... 144/82, 144/74, 69, 75, 67, 77, 78, 72
See application file for complete search history.

(56) References Cited

U.S. PATENT DOCUMENTS

| | | | | | |
|---|---|---|---|---|---|
| 478,544 | A | * | 7/1892 | Cheshire et al. | 144/87 |
| 610,272 | A | * | 9/1898 | Lindwall | 144/87 |
| 955,834 | A | * | 4/1910 | Hogland et al. | 144/69 |
| 1,163,098 | A | * | 12/1915 | McDowell | 144/82 |
| 1,177,716 | A | * | 4/1916 | Smith et al. | 144/82 |
| 2,607,375 | A | | 8/1952 | Gillespie et al. | 144/87 |
| 2,747,627 | A | | 5/1956 | Havlik | 144/85 |
| 3,232,327 | A | | 2/1966 | Baranczyk | 144/85 |
| 3,272,244 | A | | 9/1966 | Nemec | 144/87 |
| 4,061,437 | A | * | 12/1977 | Strange et al. | 408/42 |
| 4,127,153 | A | | 11/1978 | Cipollone | 144/3.1 |
| 4,787,127 | A | | 11/1988 | Beall | 29/26 A |
| 4,787,430 | A | | 11/1988 | Miyamoto | 144/144.1 |
| 4,934,422 | A | * | 6/1990 | Hempy et al. | 144/136.9 |
| 5,305,812 | A | | 4/1994 | Ferencsik | 144/356 |
| 5,598,878 | A | | 2/1997 | Wirth et al. | 144/144.51 |
| 5,655,583 | A | | 8/1997 | Heintzeman | 144/204.2 |
| 6,015,247 | A | * | 1/2000 | Branaman | 408/1 R |
| 6,422,276 | B1 | | 7/2002 | Kevan | 144/144.51 |
| 6,929,042 | B2 | * | 8/2005 | Chang | 144/71 |
| 6,991,007 | B2 | | 1/2006 | Chang | 144/71 |
| 2005/0047886 | A1 | * | 3/2005 | Liu et al. | 409/219 |
| 2009/0288736 | A1 | * | 11/2009 | Yang | 144/144.1 |
| 2010/0006180 | A1 | * | 1/2010 | Yang | 144/144.51 |

OTHER PUBLICATIONS

UK Patent Publication No. GB 300757 A, Nov. 22, 1928, 9 pages.
UK Patent Publication No. GB 2461062 A, Dec. 23, 2009, 31 pages.

* cited by examiner

*Primary Examiner* — Shelley Self
(74) *Attorney, Agent, or Firm* — Alan Kamrath; Kamrath IP Lawfirm, PA

(57) ABSTRACT

A multi-function mortise/tenon includes a chassis including a placement portion for placing a work piece horizontally/vertically and at least one transverse sliding rod. A work table includes a first base member, a second base member and a lift/lower platform provided between the first and second base members. The lift/lower platform and the first and second base members are driven to slide with respect to the chassis transversely/longitudinally. The lift/lower platform is driven to lift/lower with respect to the chassis. A guiding device is installed to the at least one transverse sliding rod slideably and transversely and is coupled to the work table which is driven by the guiding device to slide with respect to the chassis transversely/longitudinally.

19 Claims, 13 Drawing Sheets

MULTI-FUNCTION MORTISE/TENON APPARATUS

CROSS REFERENCE TO RELATED PATENT APPLICATION

This application is a continuation-in-part application of application Ser. No. 11/785,518, filed Apr. 18, 2007, now abandoned, the contents of which are incorporated herein by reference.

BACKGROUND OF THE INVENTION

1. Field of the Invention

The present invention relates to a multi-function mortise/tenon apparatus.

2. Description of the Related Art

To produce mortise/tenon on a work piece via a convention machine tool, the work piece has to be processed on a machine tool for producing tenons first and then be processed on another machine tool for producing mortises.

Therefore, it could be possible to produce tenons and mortises on the work piece by one machine tool. Also, it wastes placement space for placing two machine tools, increases maintenance costs and makes processing complex.

SUMMARY OF THE INVENTION

Accordingly, the object is achieved by providing a multi-function mortise/tenon apparatus that comprises a chassis, a work table having a lift/lower platform and a guide device. A work piece is able to be disposed on the work table in a horizontal/vertical manner and cut for forming mortise/tenon joints via the apparatus in the present invention.

The lift/lower platform lifts/lowers with respect to the chassis via a cylinder unit. The guide device is adapted to drive the work table slide transversely/longitudinally with respect to the chassis by operating a handle.

Other advantages and features of the present invention will become apparent from the following descriptions referring to the drawings.

DETAILED DESCRIPTION OF THE PREFERRED EMBODIMENTS

Figure 1:
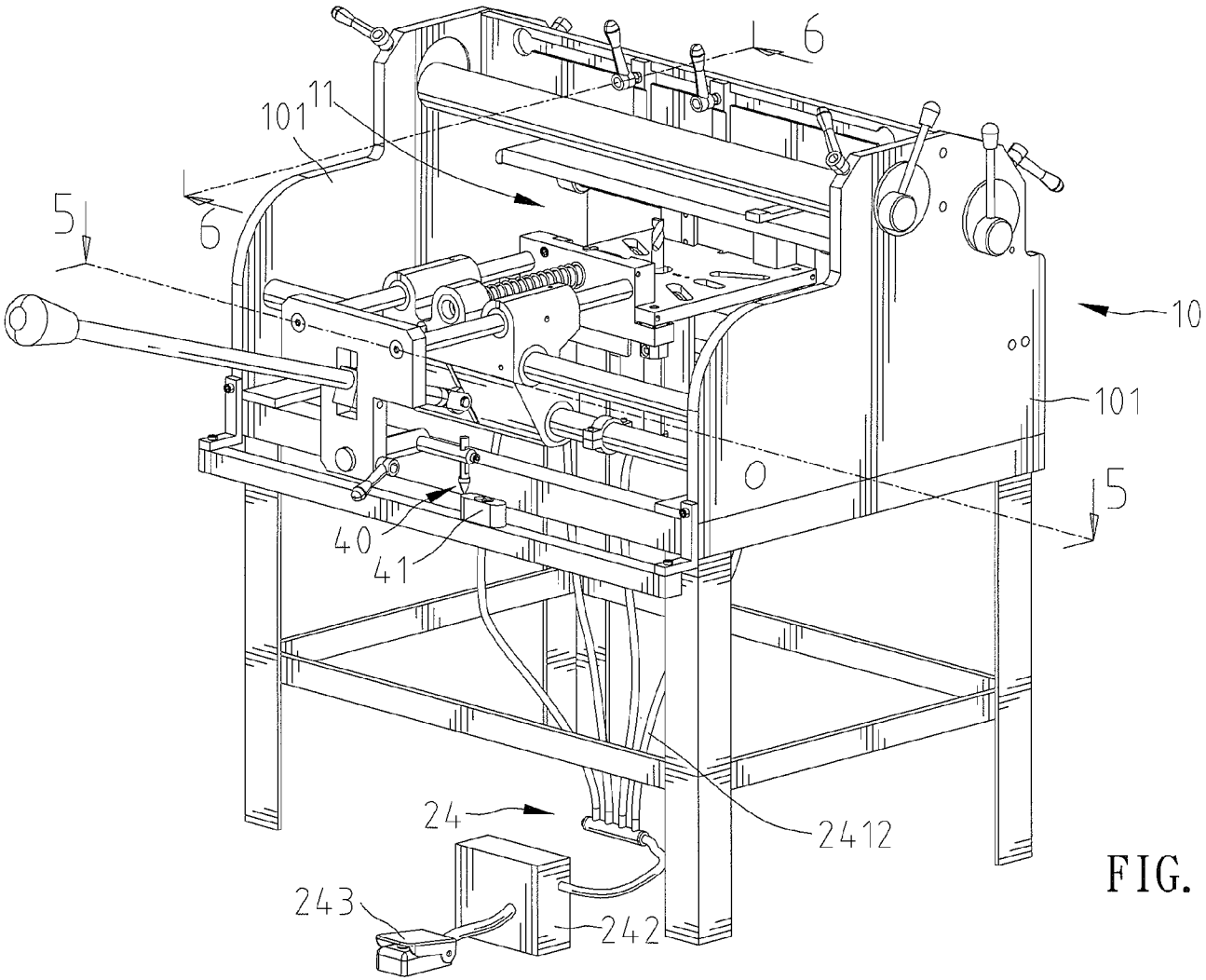
FIG. 1 is a perspective view of a multi-function mortise/tenon apparatus according to a first embodiment of the present invention.
Figure 2:
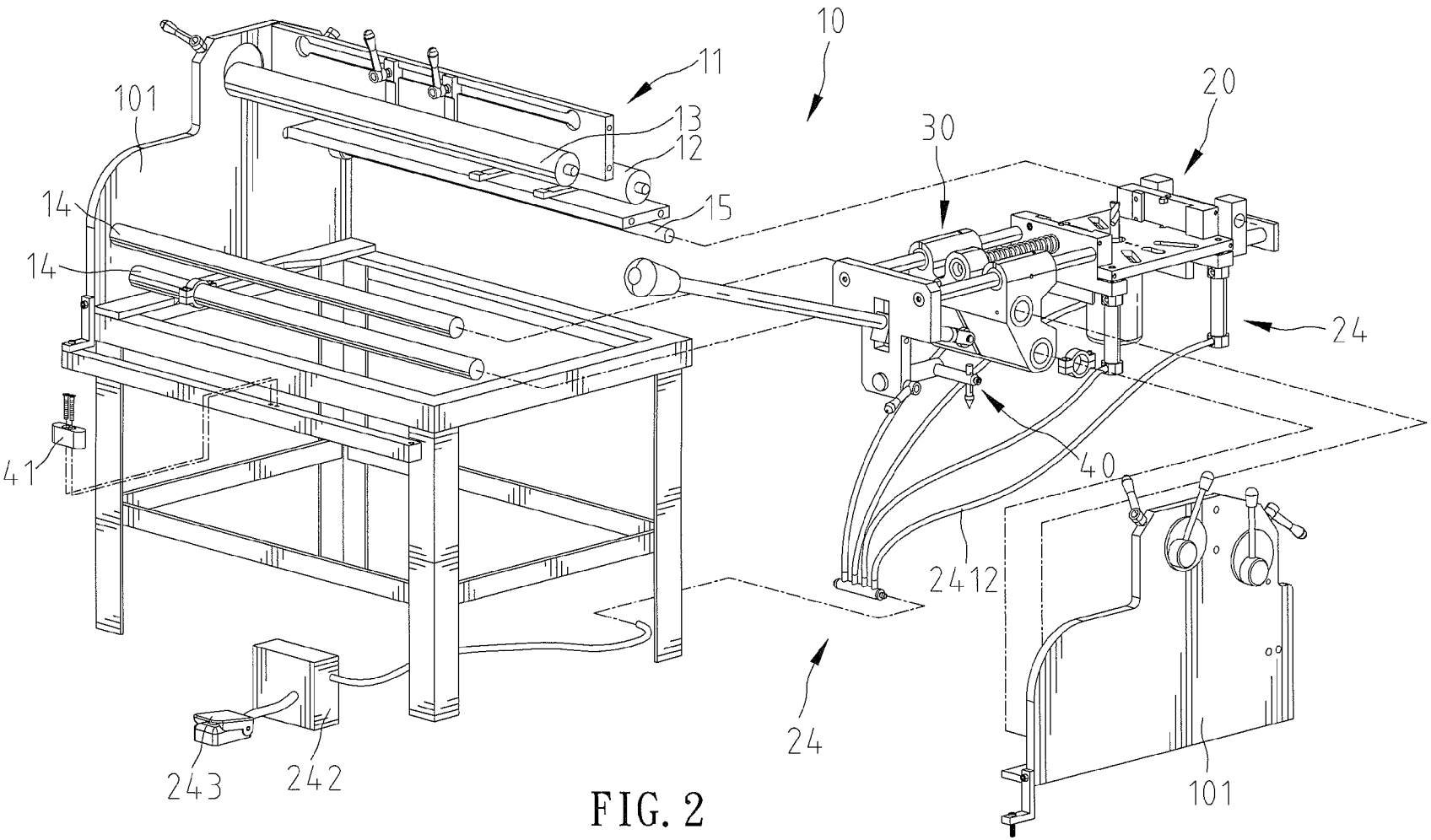
FIG. 2 is an exploded view of the apparatus shown in FIG. 1.
Figure 3:
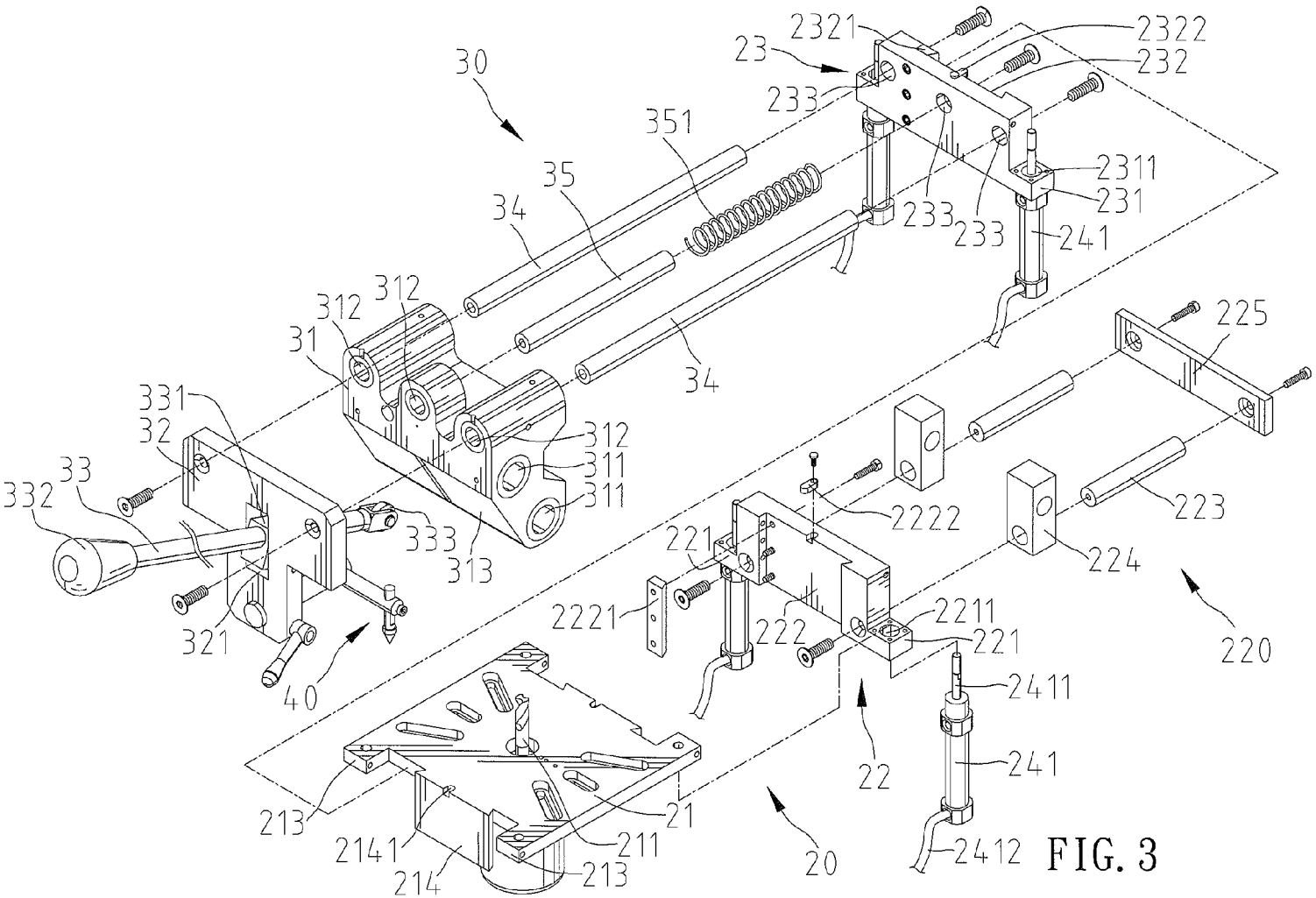
FIG. 3 is a partial, exploded view of the apparatus shown in FIG. 1.
Figure 4:
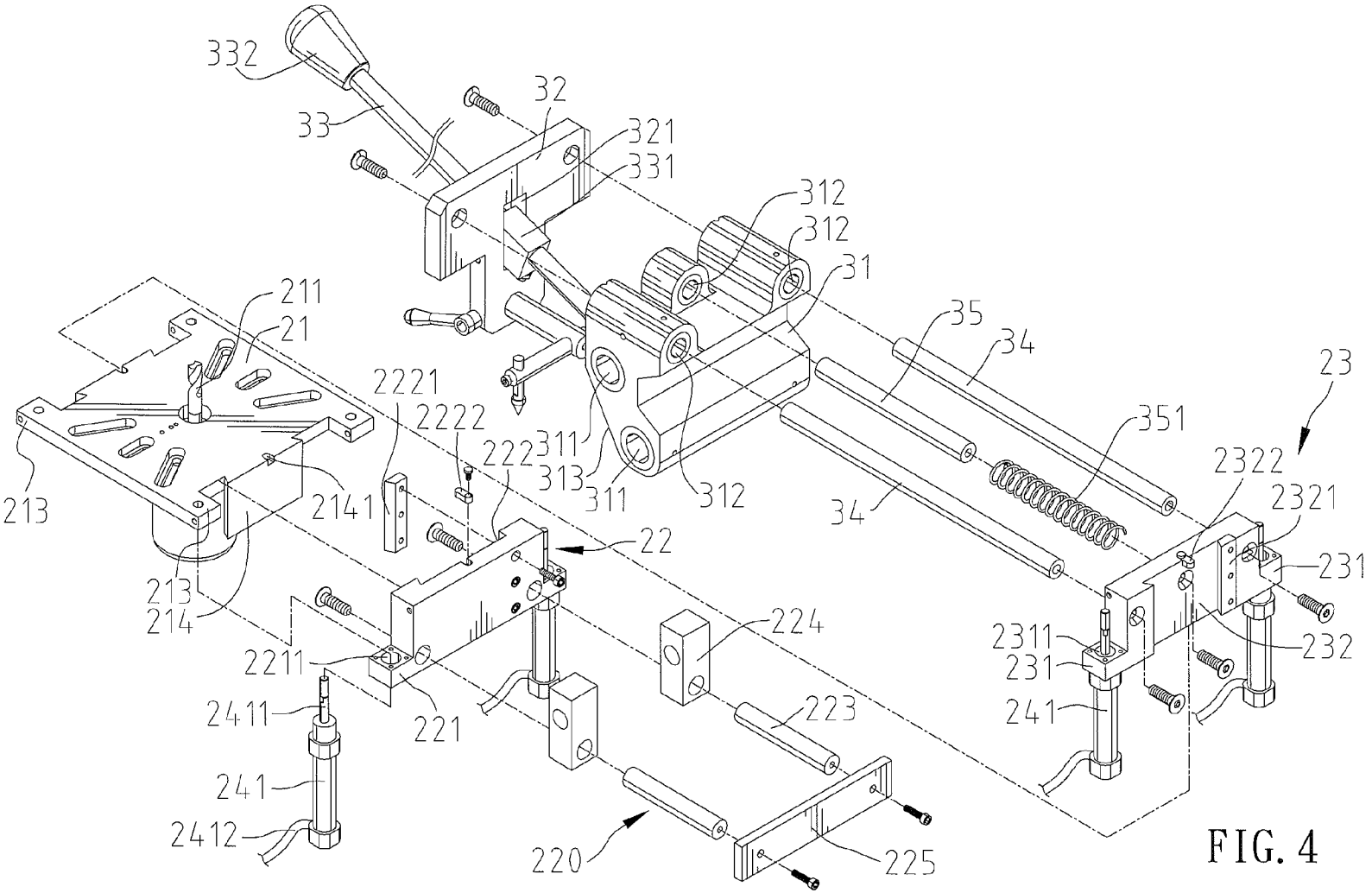
FIG. 4 is another partial, exploded view of the apparatus shown in FIG. 1.
Figure 5:
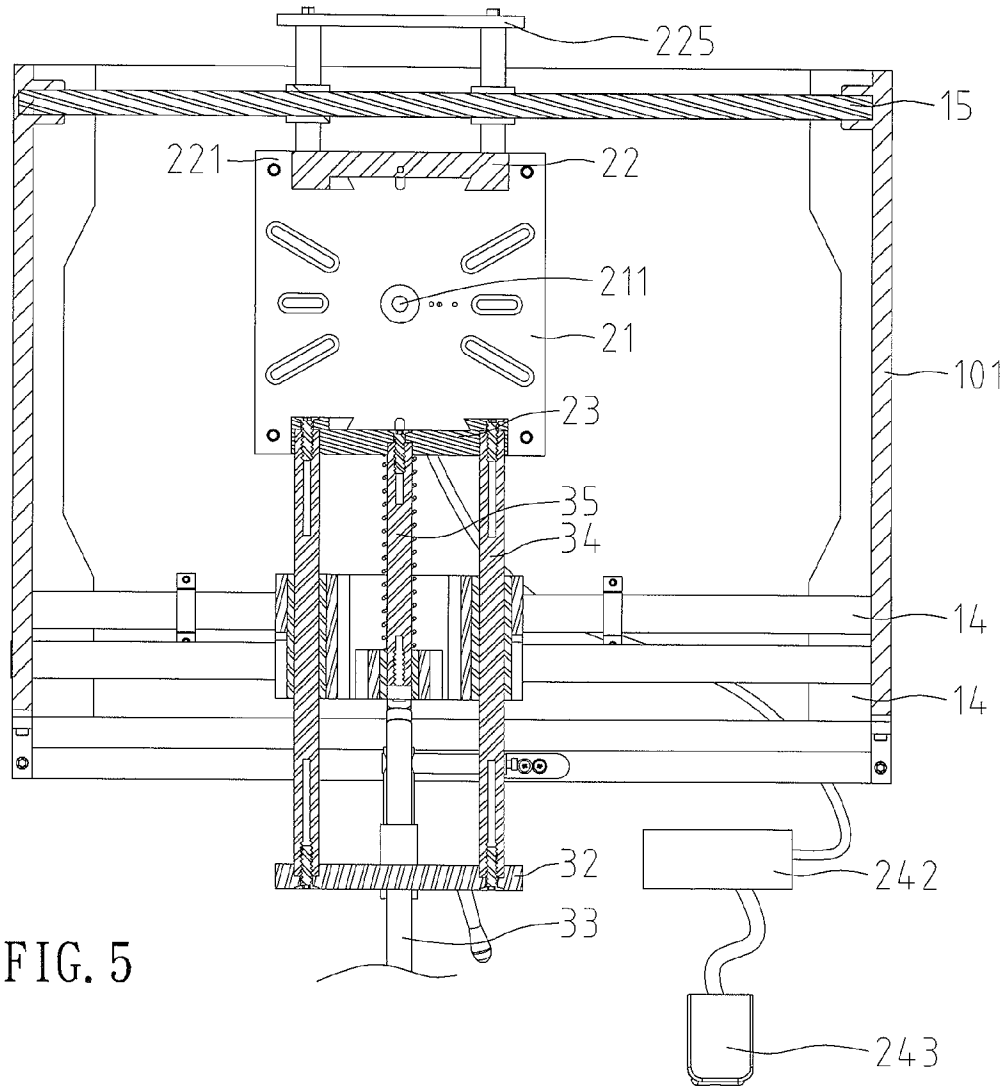
FIG. 5 is a cross-sectional view taken along line 5-5 in FIG. 1.
Figure 6:
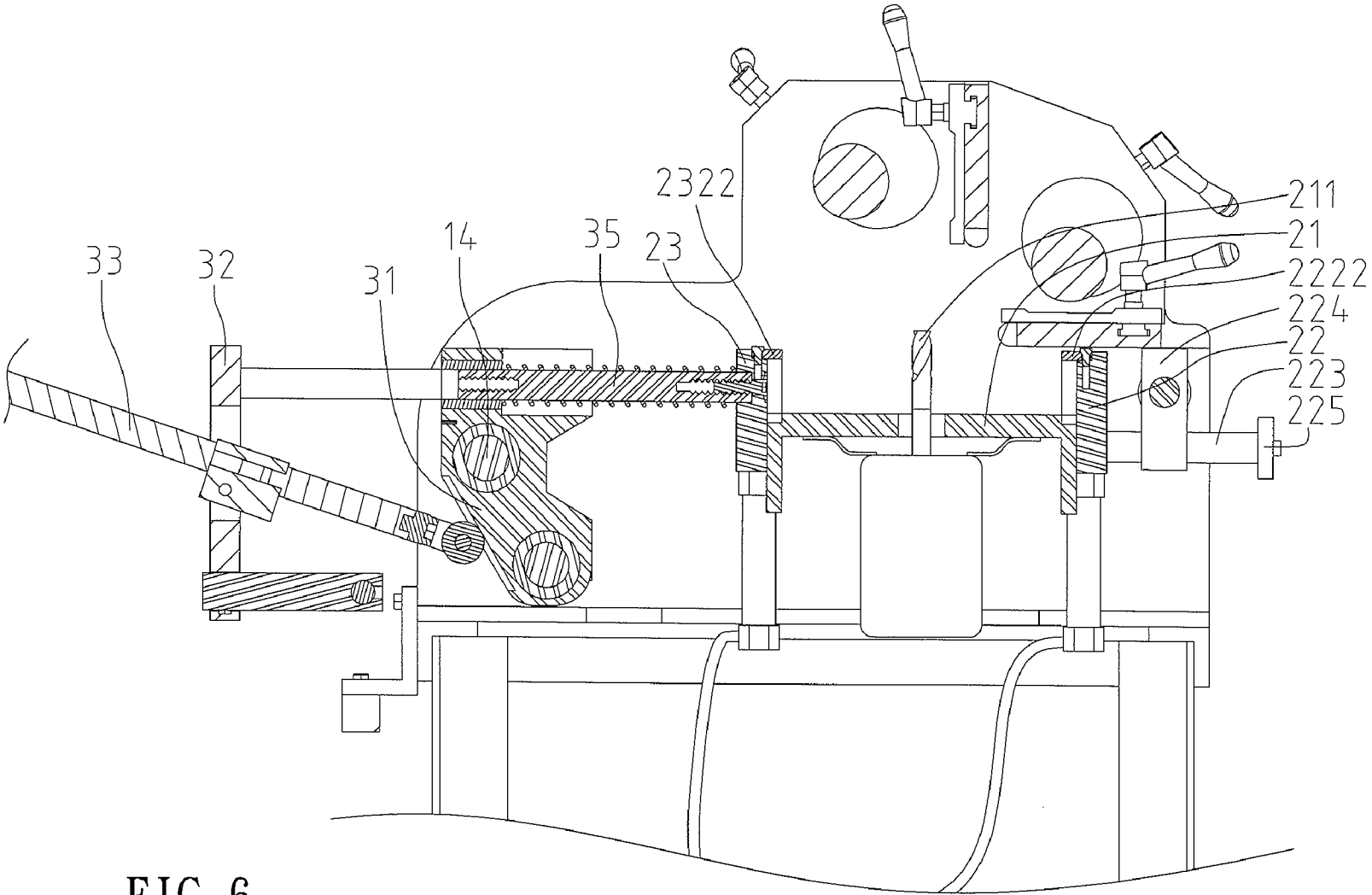
FIG. 6 is a cross-sectional view taken along line 6-6 in FIG. 1.

FIGS. 1 through 6 show a multi-function mortise/tenon apparatus including a chassis 10, a work table 20 and a guide device 30. The chassis 10 includes two sidewalls 101 provided at two sides of the top thereof. The chassis 10 further includes placement portion 11 for placing a work piece thereon in a horizontal/vertical manner, a first clamping device 12 for clamping the work piece which is horizontally disposed on the placement portion 11, a second clamping device 13 for clamping the work piece which is vertically disposed on the placement portion 11, two first sliding rods 14 transversely provided on a front end thereof opposite to the placement portion 11 and a second sliding rod 15 provided on a rear end thereof.

The work table 20, which is installed onto the chassis 10 and able to longitudinally/transversely slide along the chassis 10, includes a lift/lower platform 21 disposed below the placement portion 11, a first base member 22, a second base member 23 and a cylinder unit 24. The lift/lower platform 21 is defined between the first and second base members 22 and 23. A cutter 211 is installed at the center of the work table 20 and adapted to cut the work piece. Two connective portions 213 and a limited block 214 are defined at each of two sides of the lift/lower platform 21. The limited block 214 is provided between the connective portions 213 and has two outside-in taperedly inclined surfaces from on two sides thereof. A slot 2141 is formed on the top surface of the limited block 214.

Two connective blocks 221 are respectively provided at the bottom of two ends of the first base member 22, and the two connective portions 213 are respectively provided at two sides of the first base member 22 and correspond to the connective blocks 221. A through-hole 2211 is vertically formed on each connective block 221 with respect to the lift/lower platform 21. A side of the first base member 22 is formed with a longitudinal sliding groove 222 which is between the two ends of the first base member 22. The limiting block 214 is slideably disposed at the sliding groove 222. At least one embedded block 2221 can be provided to couple to the sliding groove 222 for engaging with the limited block 214 which is disposed in the sliding groove 222. Hence, two sides of a combination of the sliding groove 222 and the at least one embedded block 2221 and the corresponding inclined surfaces of the limited block 214 form a dovetail slot structure to limit the work table 20 to lift/lower with respect to the chassis 10. A limited block 2222 is provided at the top of the sliding groove 222 and adapted to limit the lift/lower platform 21 and to be wedged into the slot 2141. A guiding rod unit 220 is longitudinally coupled to the first base member 22 to guide the first base member 22 to slide transversely/longitudinally and includes two sliders 223, two sliding blocks 224 and a limited plate 225. An end of each slider 223 is coupled to the first base member 22, each slider 223 is inserted through the related sliding block 224, and another end of each slider 223 is coupled to the limited plate 225. Each sliding block 224 is transversely mounted on the second sliding rod 15.

In general, a structure of the second base member 23 is similar to the first base member 22. Two connective blocks 231 are respectively provided at the bottom of two ends of the second base member 23 and the other two connective portions 213 which are opposite to the first base member 22, are respectively provided at two sides of the second base member 23 and correspond to the connective blocks 231. A through-hole 2311 is vertically formed on each connective block 231 with respect to the lift/lower platform 21. A side of the second base member 23 is formed with a longitudinal sliding groove 232 which is between the two ends of the second base member 23. The limiting block 214 is slideably disposed at the sliding groove 232. At least one embedded block 2321 can be provided to couple to the sliding groove 232 for engaging with the limited block 214 which is disposed in the sliding groove 232. Hence, two sides of a combination of the sliding groove 232 and the at least one embedded block 2321 and the corresponding inclined surfaces of the limited block 214 form a dovetail slot structure to limit the work table 20 to lift/lower with respect to the chassis 10. A limited block 2322 is provided at the top of the sliding groove 232 and adapted to limit the lift/lower platform 21 and to be wedged into the slot 2141. Three connective holes 233 are formed longitudinally on the second base member 23 between two ends of the second base member 23.

The cylinder unit 24 includes a plurality of cylinders 241 respectively provided at the connective blocks 221, 231 of the first and second base members 22, 23, a pneumatic supply 242 and a control element 243. Each cylinder 241 includes a telescopic rod 2411 inserted though the related one of the through-holes 2211, 2311 of the connective blocks 221, 231 of the first and second base members 22, 23 and the connective portion 213 of the lift/lower platform 21. An air hose 2412 is connected to each cylinder 241, and a plurality of air hoses 2412 are coupled to the pneumatic supply 242 so that the telescopic rod 2411 can expand and contract to control the lift/lower platform to lift/lower by gas thrust. The control element 243 is stepped on by users for outputting gas. Further, in the present invention, the cylinder unit 24 can be driven by a hydraulic supply.

A side of the guiding device 30 is coupled to the second base member 23 of the work table 20 and drives the work table 20 to slide with respect to the chassis 10 transversely/longitudinally. The guiding device 30 includes a sliding base 31, a fixture plate 32 and a handle 33. The sliding base 31 includes two transverse first holes 311, three longitudinal second holes 312 and an inclined surface 313. The two transverse first holes 311 are respectively engaged with the two first sliding rods 14 for sliding the sliding base 31 with respect to the chassis 10. The three longitudinal second holes 312 are respectively engaged with two first guiding rods 34 and a second guiding rod 35. The second guiding rod 35 is provided between the first guiding rods 34. An elastic element 351 is mounted on the second guiding rod 35 between the sliding base 31 and the second base member 23. The inclined surface 313 is provided at a side of the sliding base 31 opposite to the placement portion 11 of the chassis 10.

The fixture plate 32 is preferably T-shaped and has first and second portions (not numbered). The first portion of the fixture plate 32 is above the second portion of the fixture plate 32. Two ends of the first portion of the fixture plate 32 respectively couple to an end of the two first guiding rods 34. The fixture plate 32 is provided at the front end of the chassis 10 opposite to the placement portion 11 and includes a through slot 321 formed on the center thereof and piercing therethrough.

A copy shaper 40 is installed below the fixture plate 32 of the guiding device 30 and includes a die 41 for controlling the cutter 211 to cut the work piece to form a desired shape.

Two ends of each first guiding rod 34 respectively couple to the first base member 22 and the fixture plate 32. An end of the second guiding rod 35 couples to the second base member 23, and another end of the second guiding rod is inserted into the second hole 312.

A coupling member 331 is mounted on the handle 33 and pivotally connected to the through slot 321 of the fixture plate 32 so that the handle 33 is able to pivot with respect to the fixture plate 32. A gripping member 332 and a roller 333 are provided at two ends of the handle 33. Users can grip the gripping member to operate the handle 33, and the roller 333 is abutted against the inclined surface 313 and able to slide along the inclined surface 313 to drive the fixture plate 32 to pull the work table 20 to slide longitudinally. During operation of the handle 33 moved downwards by users, the roller 333 is moved upwards along the inclined surface 313. The inclined angle of the inclined surface 313 allows the lift/lower platform 21 to be pushed forwards/rearwards. A combination of the roller 333 and the inclined surface 313 can save the users' effort.

Figure 7:
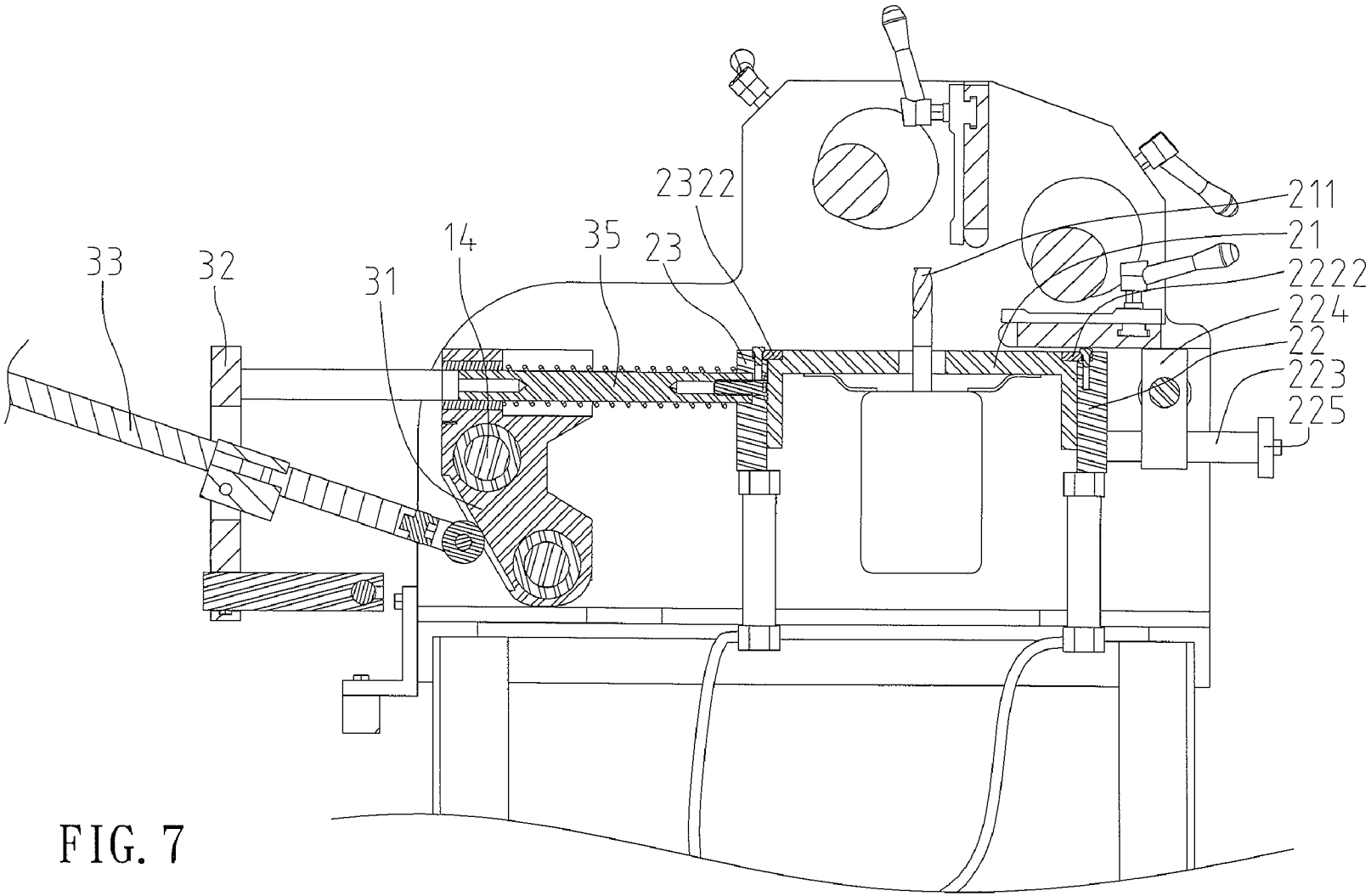
FIG. 7 is a cross-sectional view similar to FIG. 6.

Referring to FIG. 7, the lift/lower platform 21 of the work plate 20 is lifted or lowered to cut the work piece and limited between the limited blocks 2222, 2322 of the first and second base members 22, 23.

Figure 8:
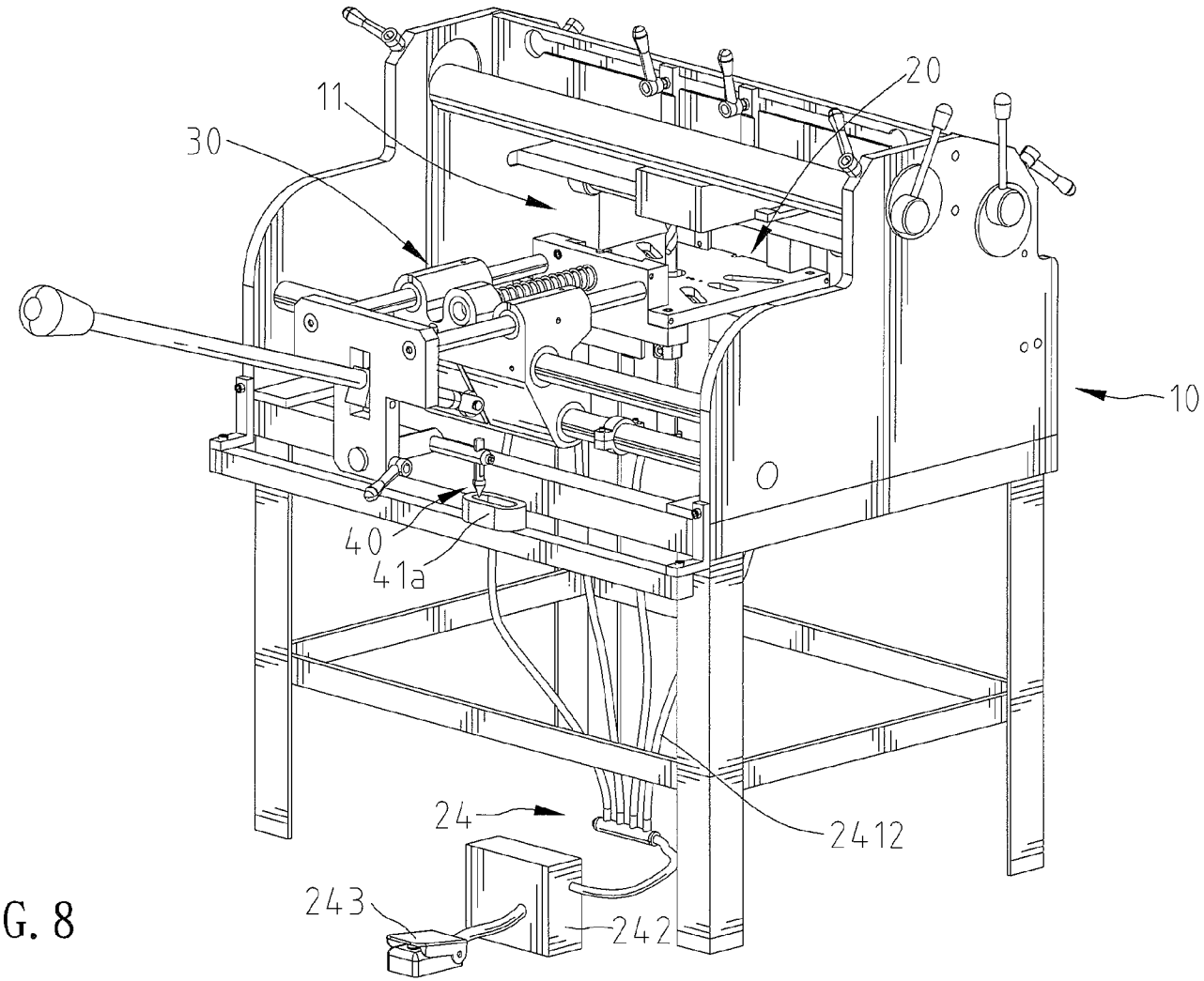
FIG. 8 is another perspective view of the apparatus shown in FIG. 1, illustrating the copy shaper attached with the other die.
Figure 9:
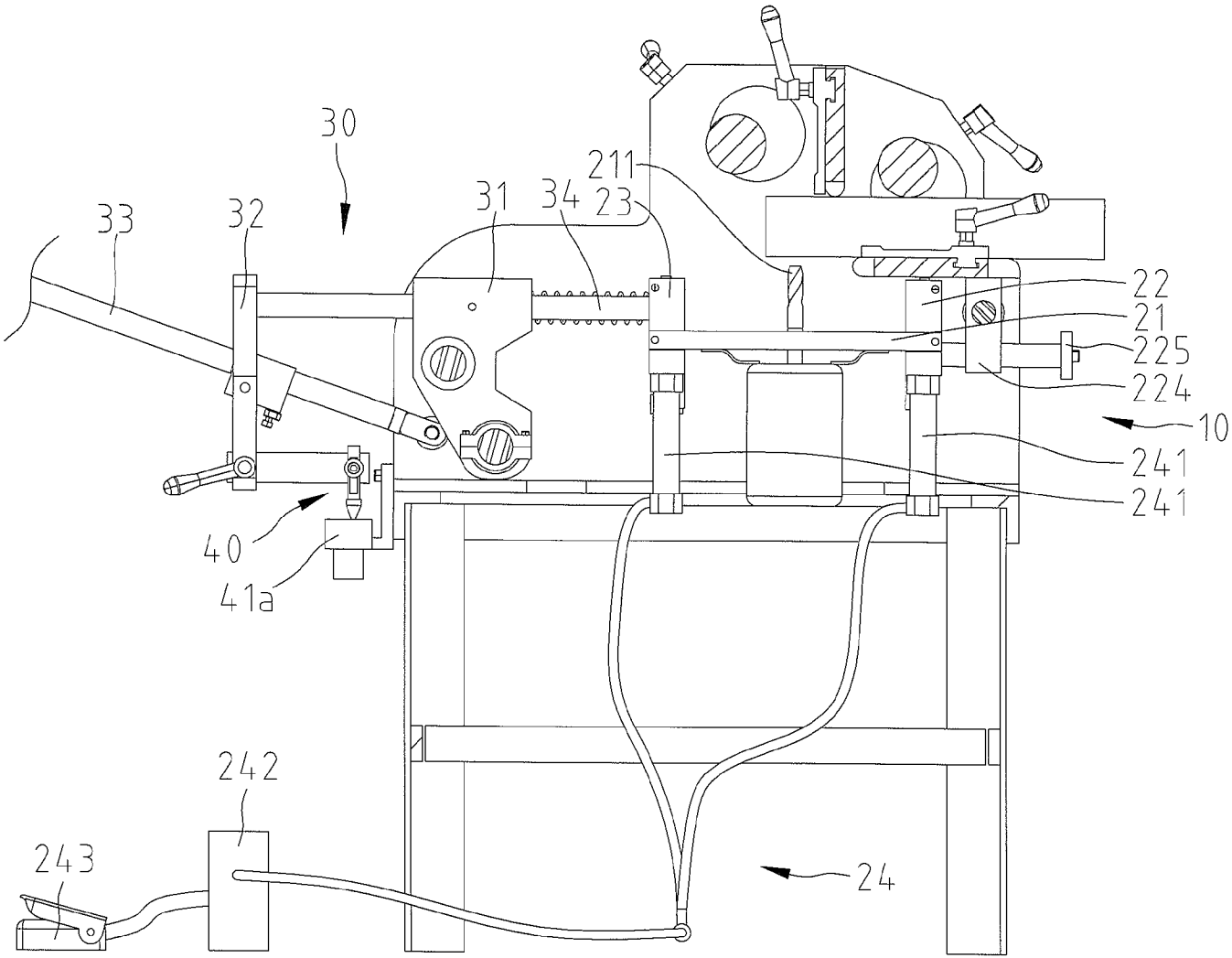
FIG. 9 is a cross-sectional view of the apparatus shown in FIG. 1.
Figure 10:
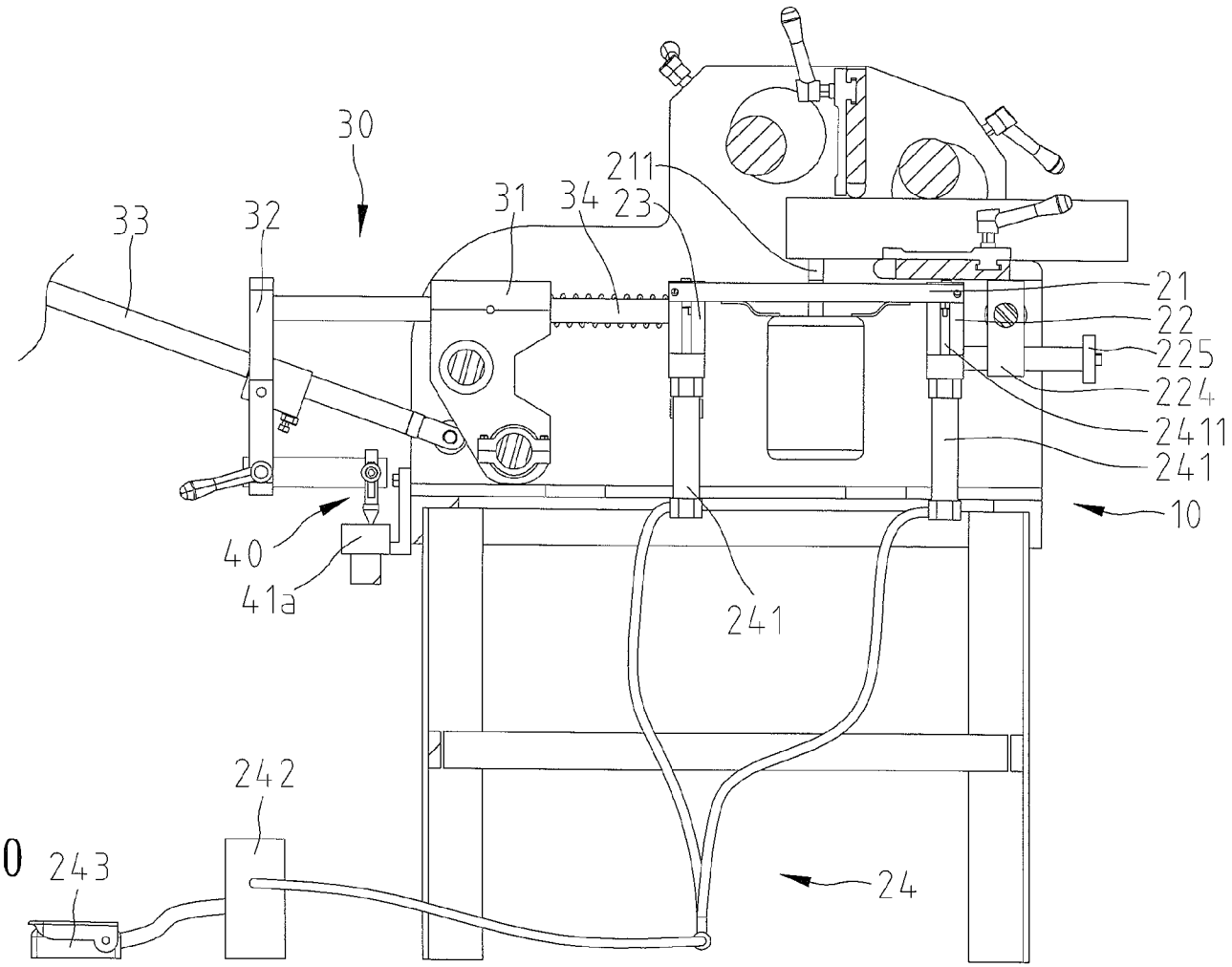
FIG. 10 is another cross-sectional view similar to FIG. 9.

Referring to FIGS. 8 through 10, the copy shaper 40 is attached with another die 41*a* for cutting mortises on the work piece. The work piece is disposed transversely onto the placement portion 11, and the die 41*a* is in form of a mortise with a desired shape. The cutter 211 of the work table 20 is driven to move below the work piece by operating the guiding device 30. Users would step on the control element 243 of the cylinder unit 24 to lift/lower the lift/lower platform 21 for cutting the work piece.

Figure 11:
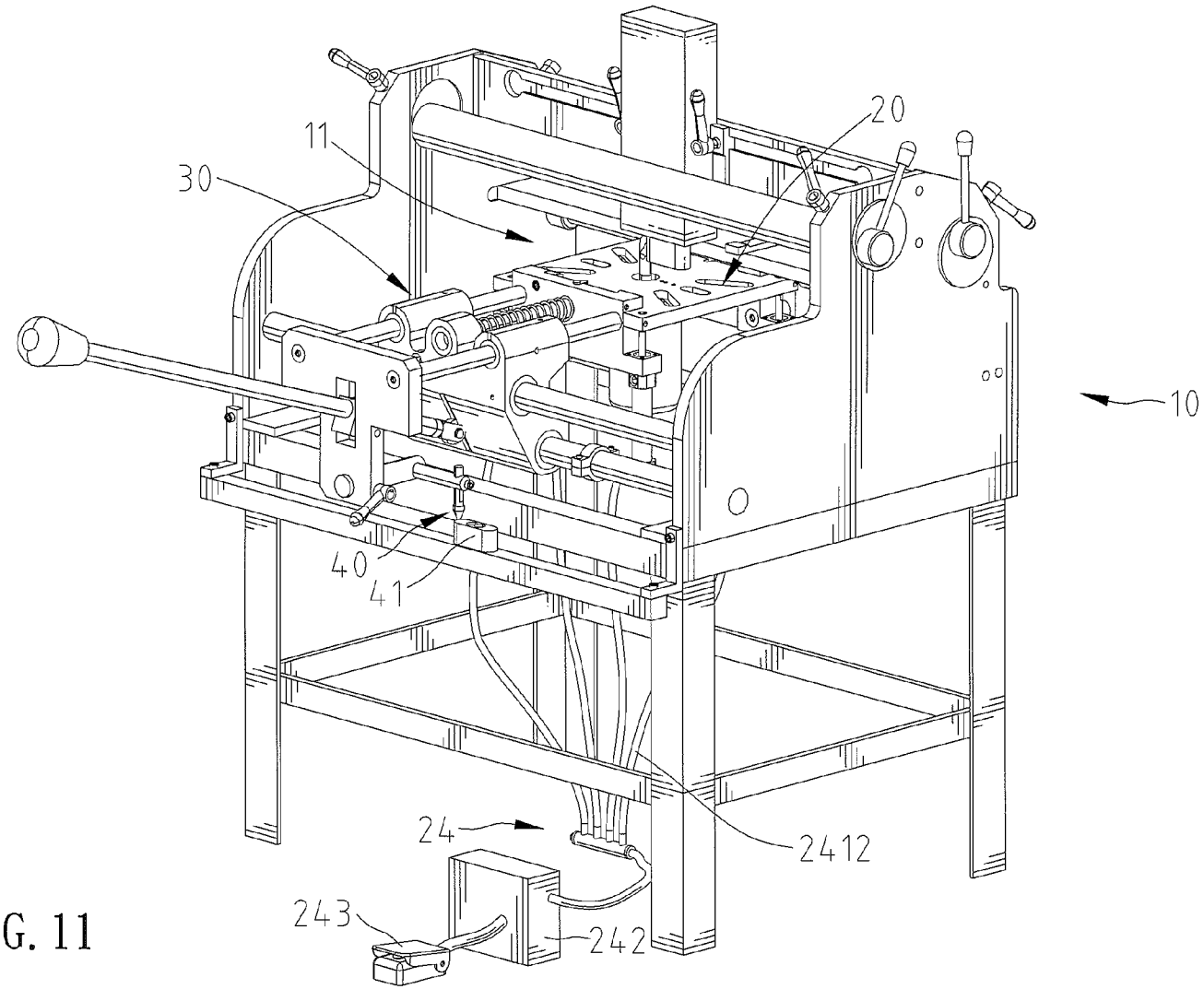
FIG. 11 is a perspective view of the apparatus shown in FIG. 1, illustrating a work piece disposed thereon.
Figure 12:
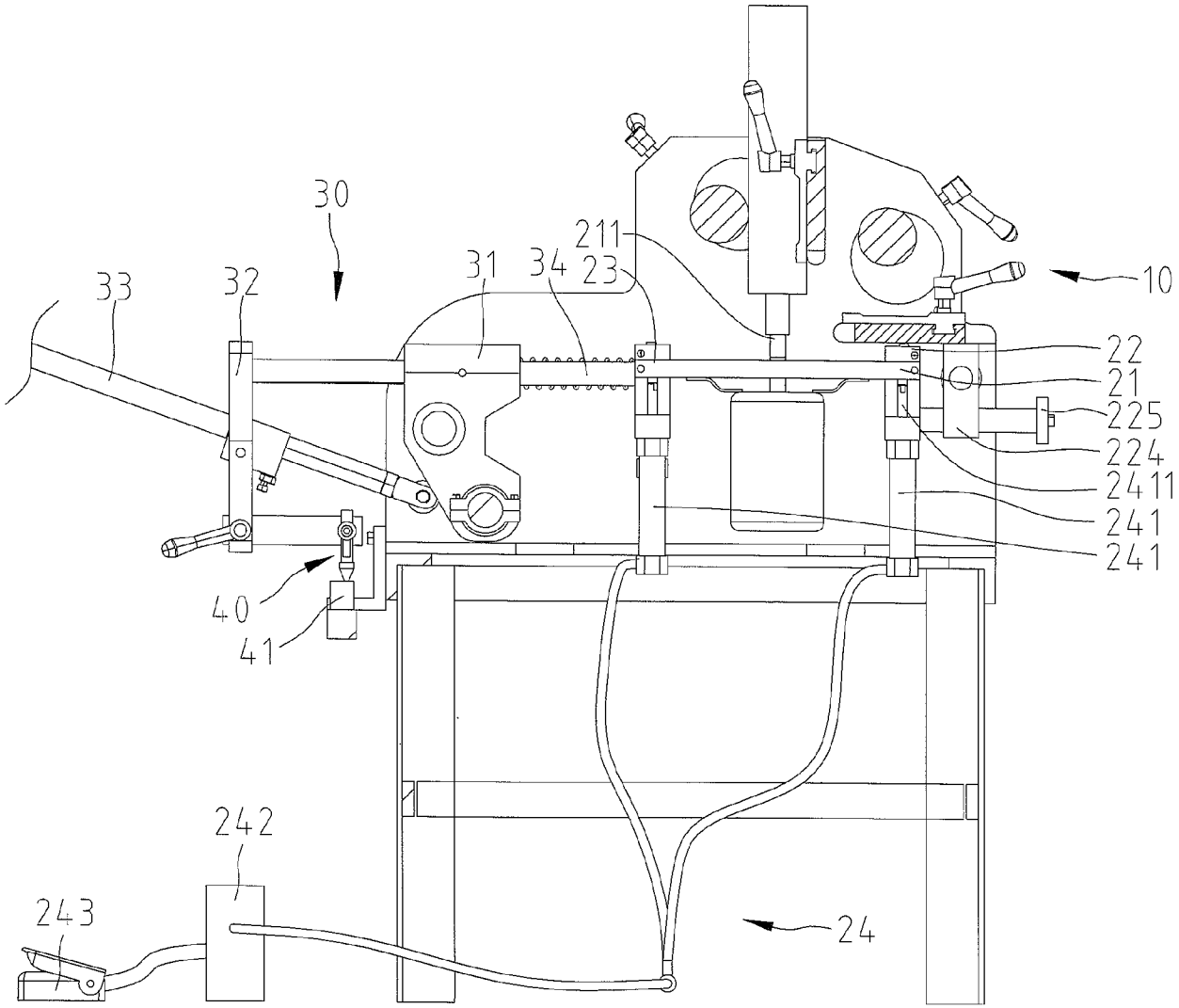
FIG. 12 is a cross-sectional view of the apparatus shown in FIG. 11.

Referring to FIGS. 11 and 12, the copy shaper 40 is attached with the die 41 for cutting tenons on the work piece. The work piece is disposed longitudinally onto the placement portion 11, and the die 41*a* is in a form of a tenon with a desired shape. The cutter 211 of the work table 20 is driven to move below the work piece by operating the guiding device 30. Users would step on the control element 243 of the cylinder unit 24 to lift/lower the lift/lower platform 21 for cutting the work piece.

Figure 13:
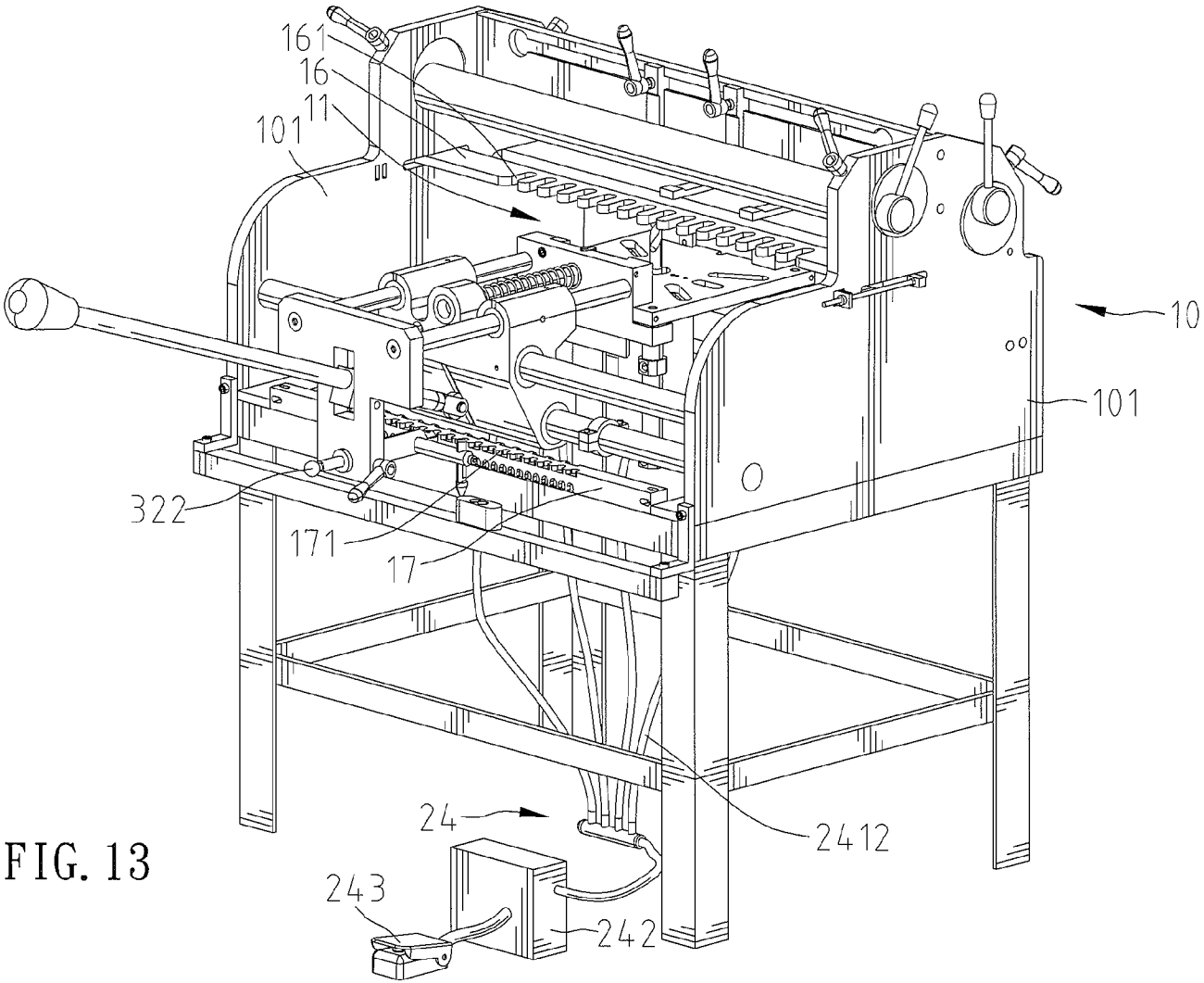
FIG. 13 is a perspective view of a multi-function mortise/tenon apparatus according to a second embodiment of the present invention.

FIG. 13 shows a multi-function mortise/tenon apparatus in accordance with a second embodiment of the present invention similar to the first embodiment except several features as follows. Firstly: a guiding plate 16 is slideably installed between the sidewalls 101 horizontally, and a plurality of openings 161 are formed at a side of the guiding plate 16 and spaced equally from one another. Secondly: a guiding rail 17 is installed between the sidewalls 101. The guiding rail 17 and the guiding plate 16 are approximately parallel to each other. A plurality of openings 171 which are formed at a side of the guiding rail 17 are spaced equally from one another correspond to the openings 161. Thirdly, a slide handlebar 322 is installed to the fixture plate 32 and has a first end that is gripped by users to drive the fixture plate 32 transversely sliding with respect to the guiding plate 16 and a second end aimed at one of the openings 171 of the guiding rail 17. Hence, by operation of the slide handlebar 322, the cutter 211 is driven by the placement portion 11 and positioned to one of the openings 161. The work piece (not shown) would be disposed on the openings 161 vertically and desired to be cut for forming a plurality of mortises and tenons (not shown) at an edge thereof. A distance of space between each opening 161 is designed to correspond to that of the mortises and tenons of the work piece. In operation, the cutter 211 is exposed from the guiding plate 16 to a position for cutting the desired mortise/tenon on the work piece.

While several embodiments of the invention have been shown and described, it will be apparent to those skilled in the art that modifications may be made therein without departing from the scope and spirit of the present invention.

What is claimed is:

1. A multi-function mortise/tenon apparatus comprising:

a chassis including a placement portion for placing a work piece horizontally/vertically and at least one transverse sliding rod;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis;

a guiding device installed to the at least one transverse sliding rod slideably and transversely and coupled to the work table which is driven by the guiding device to slide with respect to the chassis transversely/longitudinally;

a cylinder unit adapted to control the lift/lower platform to lift/lower with respect to the chassis by gas thrust, wherein the cylinder unit includes a plurality of cylinders installed to the first and second base members and each having a telescopic rod to push the lift/lower platform to lift/lower with respect to the chassis;

a cutter provided to the lift/lower platform and adapted for cutting the work piece;

two connective portions defined at each of two sides of the lift/lower platform; and connective blocks respectively provided at a bottom of two ends of the first and second base members; wherein the telescopic rod is inserted through the related one of the connective blocks and coupled to the related one of the connective portions.

2. The apparatus as claimed in claim 1 further comprising a limited block provided between the two connective portions and having two outside-in taperedly inclined surfaces from on two sides thereof, with a side of the first base member formed with a longitudinal sliding groove which is between two ends of the first base member, and with the limited block slideably disposed at the longitudinal sliding groove.

3. The apparatus as claimed in claim 2 further comprising a slot formed on the top surface of the limited block and a wedging block provided at the top of the sliding groove and adapted to limit the lift/lower platform and be wedged into the slot.

4. The apparatus as claimed in claim 3 further comprising at least one embedded block provided to couple to the longitudinal sliding groove for engaging with the limited block disposed in the longitudinal sliding groove.

5. A multi-function mortise/tenon apparatus comprising:

a chassis including a placement portion for placing a work piece horizontally/vertically and at least one transverse sliding rod;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis;

a guiding device installed to the at least one transverse sliding rod slideably and transversely and coupled to the work table which is driven by the guiding device to slide with respect to the chassis transversely/longitudinally;

a cutter provided to the lift/lower platform and adapted for cutting the work piece; and a cylinder unit adapted to control the lift/lower platform to lift/lower with respect to the chassis by gas thrust, wherein the cylinder unit includes a plurality of cylinders installed to the first and second base members and each having a telescopic rod to push the lift/lower platform to lift/lower with respect to the chassis, wherein the cylinder unit includes a pneumatic supply and a control element, with the a plurality of cylinders connected to the pneumatic supply, and with the control element being stepped on by users for outputting gas.

6. The apparatus as claimed in claim 5 further comprising a guiding rod unit longitudinally coupled to the first base member to guide the first base member to slide transversely/longitudinally.

7. A multi-function mortise/tenon apparatus comprising:

a chassis including a placement portion for placing a work piece horizontally/vertically and at least one transverse sliding rod;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis;

a guiding device installed to the at least one transverse sliding rod slideably and transversely and coupled to the work table which is driven by the guiding device to slide with respect to the chassis transversely/longitudinally;

a cutter provided to the lift/lower platform and adapted for cutting the work piece; and a guiding rod unit longitudinally coupled to the first base member to guide the first base member to slide transversely/longitudinally, wherein the chassis includes a second transverse sliding rod; wherein the guiding rod unit includes two sliders, two sliding blocks and a limited plate, with an end of each slider coupled to the first base member, with each slider inserted through the related sliding block and another end of each slider coupled to the limited plate, and with each sliding block transversely mounted on the second transverse sliding rod.

8. The apparatus as claimed in claim 7 further comprising a cylinder unit adapted to control the lift/lower platform to lift/lower with respect to the chassis by gas thrust.

9. The apparatus as claimed in claim 8 wherein the cylinder unit includes a plurality of cylinders installed to the first and second base members and each having a telescopic rod to push the lift/lower platform to lift/lower with respect to the chassis.

10. A multi-function mortise/tenon apparatus comprising:

a chassis including a placement portion for placing a work piece horizontally/vertically and at least one transverse sliding rod;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis;

a guiding device installed to the at least one transverse sliding rod slideably and transversely and coupled to the work table which is driven by the guiding device to slide with respect to the chassis transversely/longitudinally;

a cutter provided to the lift/lower platform and adapted for cutting the work piece; and a copy shaper installed to the guiding device and including a die to control the cutter to cut the work piece to form a desired shape.

11. A multi-function mortise/tenon apparatus comprising:

a chassis including a placement portion for placing a work piece horizontally/vertically and two transverse sliding rods;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis; and a guiding device installed to the two transverse sliding rods slideably and transversely and coupled to the work table which is driven by the guiding device to slide with respect to the chassis transversely/longitudinally a cutter provided to the lift/lower platform and adapted for cutting the workpiece, wherein the guiding device includes a sliding base, a fixture plate and a handle, with the sliding base slideably mounted on the two transverse sliding rods; wherein the sliding base includes two first guiding rods having two ends coupled to the work table and the fixture plate; wherein the handle pivots with respect to the fixture plate and drives the fixture plate to pull the work table to slide longitudinally.

12. The apparatus as claimed in claim 11 further comprising a second guiding rod inserted through the sliding base and having an end coupled to the work plate and an elastic element mounted on the second guiding rod.

13. The apparatus as claimed in claim 12 wherein the fixture plate includes a through slot formed on a center thereof and piercing therethrough; wherein the handle includes a coupling member mounted thereon and pivotally connected to the through slot of the fixture plate.

14. The apparatus as claimed in claim 13 further comprising a gripping member and a roller provided at two ends of the handle and an inclined surface provided at a side of the sliding base opposite to the placement portion of the chassis; wherein users grip the gripping member to operate the handle and the roller is abutted against the inclined surface and slides along the inclined surface, with the roller moved along the inclined surface.

15. The apparatus as claimed in claim 14 wherein when the handle is operated to move by users, the roller is moved along the inclined surface, with an inclined angle of the inclined surface allowing the lift/lower platform to be pushed forwards/rearwards.

16. A multi-function mortise/tenon apparatus comprising:

a chassis including a placement portion for placing a work piece and two transverse sliding rods;

a work table including a first base member, a second base member and a lift/lower platform provided between the first and second base members;

a cutter provided to the lift/lower platform and adapted for cutting the work piece;

wherein the lift/lower platform and the first and second base members are able to slide with respect to the two transverse sliding rods of the chassis transversely/longitudinally; wherein the lift/lower platform is driven to lift/lower with respect to the chassis; and a guiding device installed to the two transverse sliding rods slideably and transversely and coupled to the work table which is driven by the guiding device to slide with respect to the chassis transversely/longitudinally;

wherein the guiding device further includes a sliding base, a fixture plate and a handle, with the sliding base slideably mounted on the two transverse sliding rods; wherein the sliding base includes two guiding rods having two ends coupled to the work table and the fixture plate; wherein the handle pivots with respect to the fixture plate and drives the fixture plate to pull the work table to slide longitudinally;

wherein the sliding base further includes an inclined surface provided at a side thereof opposite to the placement portion of the chassis; wherein users grip a first end of the handle to operate the handle and a second end of the handle is abutted against the inclined surface and slides along the inclined surface;

wherein when the handle is operated to move by users, the second end of the handle is moved along the inclined surface, with an inclined angle of the inclined surface allowing the lift/lower platform to be pushed forwards/rearwards.

17. The apparatus as claimed in claim 16 wherein the handle further includes a gripping member and a roller provided at the first and second ends thereof; wherein users grip the gripping member to operate the handle and the roller is abutted against the inclined surface and slides along the inclined surface, with the roller moved along the inclined surface;

wherein when the handle is operated to move by users, the roller is moved along the inclined surface.

18. A multi-function mortise/tenon apparatus comprising:

a chassis including a placement portion for placing a work piece horizontally/vertically and at least one transverse sliding rod;

a work table including a first base member, a second base member and a lift/lower platform provided between the first and second base members;

wherein the lift/lower platform and the first and second base members are driven to slide with respect to the at least one transverse sliding rod of the chassis transversely/longitudinally; wherein the lift/lower platform is driven to lift/lower with respect to the chassis;

a guiding device installed to the at least one transverse sliding rod slideably and transversely and coupled to the work table which is driven by the guiding device to slide with respect to the chassis transversely/longitudinally;

a cutter provided to the lift/lower platform and adapted for cutting the work piece;

a guiding plate slideably installed between sidewalls of the chassis horizontally and formed with a plurality of openings at a side thereof and spaced equally from one another; and a guiding rail installed between the sidewalls of the chassis and formed with a plurality of openings at a side thereof spaced equally from one another and corresponding to the plurality of openings of the guiding plate; wherein the cutter is exposed from the guiding plate to a position for cutting the desired mortise/tenon on the work piece.

19. The apparatus as claimed in claim 18 further comprising a slide handlebar installed to the guiding device and having an end aimed at one of the plurality of openings of the guiding rail; wherein by operation of the slide handlebar, the cutter which is provided to the lift/lower platform is driven to be positioned corresponding to one of the plurality of openings of the guiding plate.

* * * * *